73-654 SR
5/14/85 XR 4,516,428

United States Patent [19]

Konomi

[11] Patent Number: 4,516,428

[45] Date of Patent: May 14, 1985

[54] ACCELERATION VIBRATION DETECTOR

[75] Inventor: Masao Konomi, Tokyo, Japan

[73] Assignee: Pan Communications, Inc., Japan

[21] Appl. No.: 480,723

[22] Filed: Mar. 31, 1983

[51] Int. Cl.[3] ..... H04R 19/00; H04R 25/02

[52] U.S. Cl. ..... 73/585; 73/654; 179/111 E

[58] Field of Search ..... 73/654, 585, 652, 658, 73/632; 179/111 R, 111 E, 107 R; 381/113

[56] References Cited

U.S. PATENT DOCUMENTS

| | | | |
|---|---|---|---|
| 4,150,262 | 4/1979 | Ono | 179/107 BC |
| 4,170,721 | 10/1979 | Ishibashi et al. | 179/111 R |
| 4,236,051 | 11/1980 | Nakagawa et al. | 179/111 E |
| 4,321,432 | 3/1982 | Matsutani et al. | 179/111 R |

FOREIGN PATENT DOCUMENTS

| | | | |
|---|---|---|---|
| 794782 | 1/1981 | U.S.S.R. | 179/111 R |

*Primary Examiner*—Stephen A. Kreitman
*Attorney, Agent, or Firm*—Finnegan, Henderson, Farabow, Garrett & Dunner

[57] ABSTRACT

An ear microphone for an external auditory canal insertion type two-way communication earpiece. Within the casing of the earpiece a fixed electrode and a vibrating electrode are positioned in capacitive relation with each other, the vibrating electrode for detecting acceleration vibration from outside the casing in the form of bone-conducted voice sound vibration within the external auditory canal. Electrical signals transduced from picked-up voice sounds pass through an impedance conversion circuit mounted in the ear microphone.

19 Claims, 17 Drawing Figures

ACCELERATION VIBRATION DETECTOR

BACKGROUND OF THE INVENTION

The present invention relates to a small but effective electrostatic type sensor, which detects acceleration vibration of an object and converts it into an electrical signal, and more particularly to an acceleration vibration detector to be mounted in an earpiece (ear microphone), which is inserted into a human external auditory canal to detect therefrom a bone-conducted voice sound vibration generated by the wearer's speech and convert it into an electrical signal representing a voice sound.

An ear microphone mounted together with a speaker in an earpiece is shown in FIG. 1, as disclosed in pending U.S. patent application Ser. No. 428,017, filed Sept. 29, 1982, in the name of the present inventor. This earpiece enables its wearer to talk and listen simultaneously or alternately (two-way voice communication). The acceleration vibration detector of the ear microphone of FIG. 1 is a piezoelectric type. Numeral 1 designates a cylindrical cavity in a metal casing B having an ear microphone therein. Support member 2 of a plastic material is fitted into an open end portion of cavity 1 of enlarged diameter. Piezoelectric element 3 is fixedly supported in cantilever fashion by support member 2, which as positioned against a shoulder in the wall of cavity 1 formed by the enlarged diameter. Output lead wire A1 sends out voice sound electrical signals developed by the piezoelectric element 3. The balance of the structure of FIG. 1 is explained in detail later with reference to FIG. 5. The same signs and numerals in FIGS. 1 and 5 indicate the same parts of the earpiece.

Bone-conducted voice sound vibration generated by the wearer's speech is first conducted to casing B which in turn conducts the vibration through support member 2 to piezoelectric element 3. As a result, an electric signal is obtained through output lead wire A1.

The output of the piezoelectric element 3 has a frequency characteristic as shown by line "a" in FIG. 2, which has a disproportionately high peak at its intrinsic resonance frequency fo. Therefore, an ear microphone of this type has a drawback that its sensitivity is remarkably high at this frequency, whereas the sensitivity is comparatively low at the rest of the frequency range, resulting in need for more equalization processing at a later stage and more likelihood of causing a detrimental feedback at this frequency.

In addition, as shown in FIG. 1, the required axial length of element 3 limits space to be allocated for structure needed for lessening acoustical coupling (feedback) between the ear microphone and speaker. This ear microphone has other drawbacks including generation of noises inherent to the piezoelectric element and a structure difficult for quantity production due to soldering needs of very thinly stranded wires in the connections to piezoelectric element 3.

SUMMARY OF THE INVENTION

The object of the present invention is therefore to provide an acceleration vibration detector of an ear microphone, which has a high sensitivity, a size as small as 5 mm in any direction and a structure suited for quantity production, while assuring a desired frequency characteristic in consideration of its application to an ear microphone.

This object is attained in a electrostatic type acceleration vibration detector including a metal casing have a closed end and an open end, the metal casing vibrating in response to physical vibrations originating outside the casing, a grounded vibrating electrode in physical contact with the metal casing near the closed end for vibrating in response to any vibrations of the metal casing, a fixed electrode located between the vibrating electrode and the open end, the fixed electrode being positioned in capacitive relation with the vibrating electrode and insulated from the metal casing, a transistor positioned between the fixed electrode and the open end, means for supporting the fixed electrode and the transistor in the metal casing, and a printed circuit board transverse the metal casing between the transistor and the open end, the circuit board having conductive patterns on its outer surface, the source and drain terminals of the transistor being connected to individual ones of said conductive patterns, the edge portions of the open end of the metal casing being bent inwardly to contact the outer surface of the circuit board and to apply pressure against the supporting means for mechanically clamping the gate electrode of the transistor in electrical connection with the fixed electrode, the conductive pattern connected with the source electrode being under pressure electrical contact with said edge portions.

BRIEF DESCRIPTION OF THE DRAWINGS

These and other objects, advantages, features and uses of the invention will become apparent as the description proceeds, when considered with the accompanying drawings in which.

DETAILED DESCRIPTION OF THE EMBODIMENTS

Figure 1:
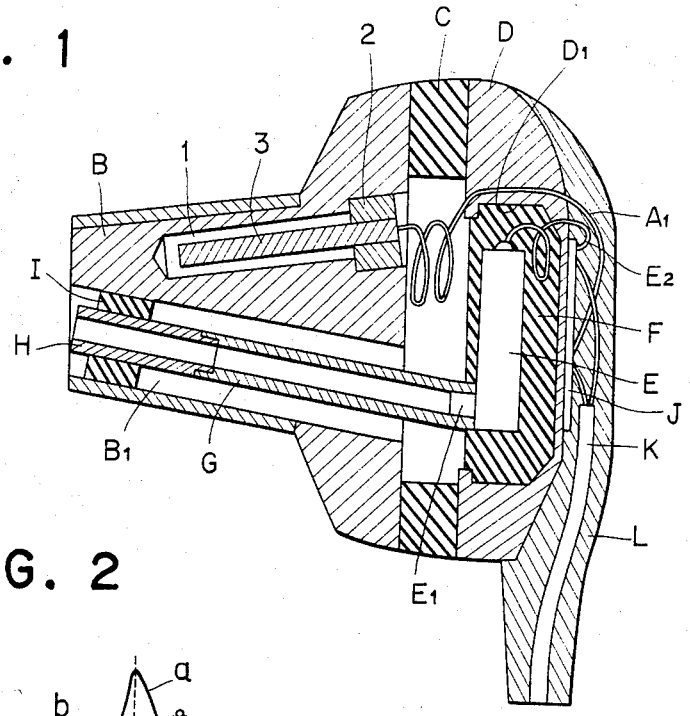
FIG. 1 is a longitudinal cross section of an ear microphone using a piezoelectric element and mounted together with a speaker in an earpiece.

Explanation will be given with reference to FIGS. 3A and 3B, which illustrate an embodiment of the present invention. Numeral 4 designates a hollow cylindrical metal casing having one end closed and the opposite end open. Preferably the metal is aluminum with a thickness of about 0.3 mm.

Metal ring spacer 5 is fitted into the hollow metal casing 4 against the closed end. Vibrating electrode 6 is preferably a diaphragm prepared with a coating of vapor-deposited metal onto a metal foil or polyester film. The thin membrane structure of electrode 6 extends across the hollow metal casing 4 and is held in physical and electrical contact herewith by the clamping action of the metal ring spacer 5 and a ring spacer 7 formed of insulating material. In this embodiment, the coating of vapor-deposited metal is made on at least one side of the foil or film but may be on both sides of the membrane.

Support body 8 of plastic insulation is placed outwardly of the ring spacer 7 toward the open end of casing 11. Recesses 8*a* and 8*b* are formed in the inner and outer sides of the support body 8. Numeral 9 designates a fixed electrode adhesively fixed in recess 8*a* of support body 8. Vibrating electrode 6 extends in facing relation to fixed electrode 9. Electret 10 may be applied on the face of the fixed electrode 9 on a surface opposite the vibrating electrode 6 to effectively hold an electric charge.

A field effect transistor (FET) 11 is located in recess 8*b* of the support body 8 for transmitting electrical signals from the capacitor formed by the vibrating and fixed electrodes and for impedance conversion as explained in more detail hereinafter. Gate terminal 11*a* of FET 11 electrically is connected to the fixed electrode 9 by pressure between the insulating support body 8 and the fixed electrode 9, as explained hereinafter. A printed circuit board 12 is provided between the support body 8 and the open end of the casing 4. Grounding pattern 12*a* and signal pattern 12*b* (FIG. 3B) are formed in the exposed face i.e., the outer surface, of the printed circuit board 12, to which source 11*b* and drain 11*c* of FET 11 are respectively connected through the circuit board.

When the above-mentioned components have been inserted into metal casing 4 in the order as described above, terminal edge portions 4*a* of metal casing 4 are press bent inwardly to contact grounding pattern 12*a* such that the source terminal 11*b* and the casing 4 are electrically connected. At the same time, the components within metal casing 4 are pressed together with the result that the electrical connection between gate 11*a* and fixed electrode 9 is made by the mechanical pressure caused by the bent edge portions 4*a* through the circuit board 12 against the support body 8 eliminating the need for soldering wires. This structure of connection improves quantity production efficiency significantly.

Figure 3A:
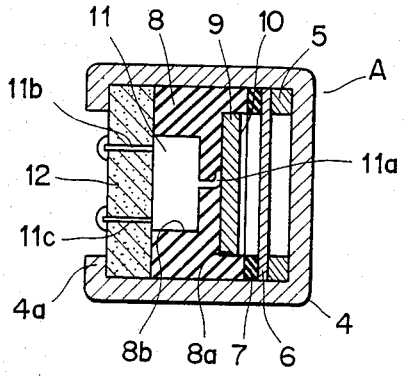
FIG. 3A is a longitudinal cross section of one embodiment of the present invention.
Figure 3B:
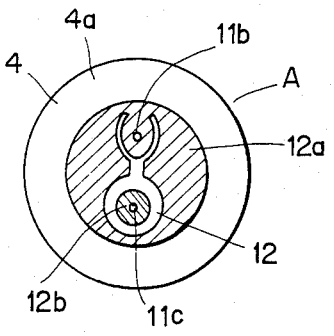
FIG. 3B is an end view of the structure of FIG. 3A.
Figure 3C:
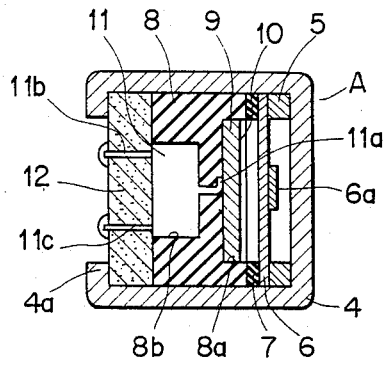
FIG. 3C is a longitudinal cross section of a modification of the embodiment of FIG. 3A.

A modification of the acceleration vibration detector of the invention is shown in FIG. 3C. In this modification, the mass of vibrating electrode 6 is increased by attaching, as by rubber-based adhesives, a piece of solid material, such as aluminum to vibrating electrode 6 as shown by weight 6*a* in FIG. 3C. The weight 6*a* is preferably about 0.5 mm thick. The thickness of the metal coating in this modification is about 0.1 or 0.2 u. The structure of this modification is not discussed further herein, because the rest of its structure and operation is identical to that of the embodiment shown in FIGS. 3A and 3B.

The arrangement of the structure, as described above, results in a resonating cavity S divided into two sections by the vibrating electrode 6.

As far as the operation of the embodiment shown in FIGS. 3A and 3B, with its modification in FIG. 3C, is concerned, electrode 6 vibrates when acceleration vibration impinges on casing 4 from outside the casing. This vibration causes a capacity change between grounded vibrating electrode 6 and fixed electrode 9, generating an electric signal to be applied to FET 11. The voltage applied to FET 11 is expressed as follows:

$$V=Q/C$$

wherein Q is the electric charge of electret 10 and C is the capacity between vibrating electrode 6 and fixed electrode 9. FET 11 also has the purpose of lowering the output impedance between fixed electrode 9 and vibrating electrode 6 which is otherwise high. Source 11*b* of FET 11 is connected by way of earth pattern 12*a* on printed circuit board 12 to casing 4 for grounding.

Figure 4:
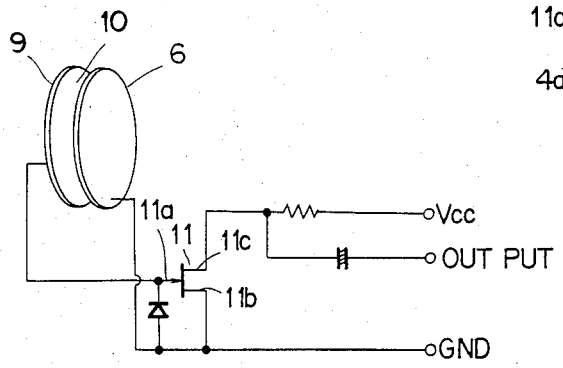
FIG. 4 is a diagram showing circuitry of the detector of the present invention.

Circuitry for lowering the impedance by means of FET 11 is shown in FIG. 4. In addition to the connection of the electrodes of FET Il, as previously described, a feedback connection is provided from the source 11*b* to the gate 11*a* with a diode to prevent reverse current. As indicated in FIG. 4, the vibrating electrode 6 is grounded, and both a driving voltage and the output may be connected to the drain 11C via the circuit board 12.

Electret 10 makes the ear microphone significantly sensitive due to its large capacity to carry electric charge. However, an ear microphone without the electret also works well, due to the variable capacity between the vibrating electrode 6 and the fixed electrode 9, and is considered another embodiment of the present invention.

Electrode 6 vibrates sufficiently in response to the external accelerating vibration by virtue of its vapor deposited metal layer and/or attached weight 6*a*. As a result, a relatively large output voltage and a generally flat frequency characteristic of the output is obtained as shown by line "b" in FIG. 2. In this arrangement, gate 11*a* of FET 11 and fixed electrode 9 are substantially sealed by casing 4 and printed circuit board 12 with the result that induction and interference noise is eliminated by the shield of casing 4 and printed circuit board 12, even if gate 11*a* has a high impedance output.

Figure 5:
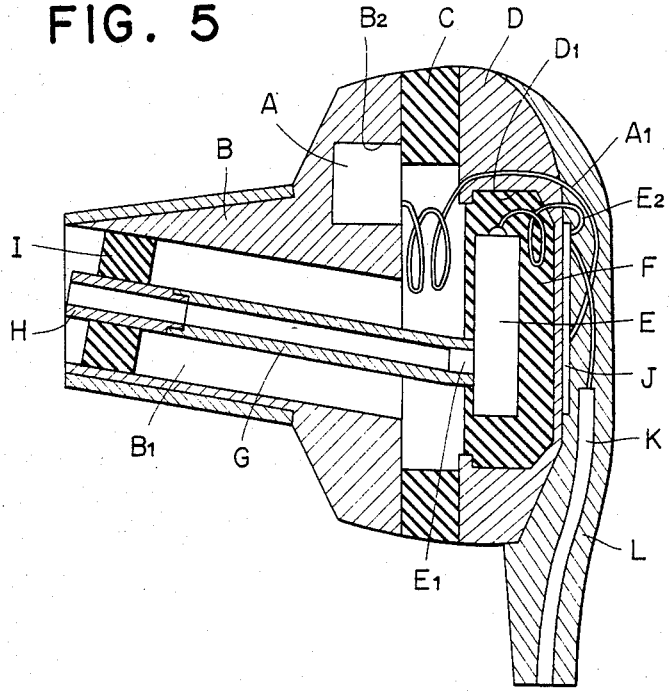
FIG. 5 is a longitudinal cross section for the two-way voice communication earpiece incorporating the ear microphone of the present invention.

FIG. 5 shows one application of the ear microphone of the present invention, wherein the ear microphone A is installed within an external auditory canal in an insertion type two-way communication earpiece. Pickup element B has a configuration suitable for insertion into the external auditory canal and is made of material having a large mass such as zinc die casting. The pickup element B is formed with a throughbore B1 and installation cavity B2. Within the installation cavity B2 is fixedly installed ear microphone A. External damper C, adhesively fastened to the back of pickup element B, is formed of soft silicone rubber or soft urethane rubber. Support body D coupled to the pickup element B by way of external damper C is made of the same large mass material as pickup element B. Support body D is formed with speaker accommodation section D1. Speaker E is positioned within the speaker accommodation section D1 in a condition so that speaker E is floated by speaker damper F made of high resiliency material or structure (for example, silicone rubber gel castings capable of maintaining a predetermined shape).

Sound tube G made of a thin silicone shell having a high resiliency is inserted into the throughbore B1 in the pickup element B and one end thereof extends through a space defined by damper C so that the sound tube G is coupled to sound emanating section E1 of speaker E. Metal pipe H coupled to the other end of the sound tube G opens at the forward end of the pickup element B.

Sound tube damper I made of high resiliency material, or structure, resiliently supports metal pipe H.

Intermediate circuit board J is fixedly attached to the surface of support body D. Lead wire A1 of the ear microphone A and lead wire E2 of speaker E are connected to intermediate board J. Lead wires A1 and E2 are made of fine stranded wires so that they do not affect the highly resilient structure of the earpiece. Outer lead wire K is connected to lead wires A1 and E2 by way of intermediate board J. Outer covering L covers support body D and outer lead wire K is molded into outer covering L. Lead wire A1 is connected to a transmitter by way of one pair of lead wires included in outer lead wire M, while lead wire E2 is connected to a receiver by way of another pair in outer lead wire M. It is to be noted that, due to the small size of ear microphone A, a relatively large space is available for structure to lessen feedback from speaker E to ear microphone A.

In operation, the speech of the wearer is conducted to pickup element B in the form of bone-conducted vibration and is converted into electrical signals by ear microphone A. These electrical signals, after going through the impedance conversion circuit including FET 11, are led out by way of lead wire A1, intermediate board J, the one pair in lead wires M, and to a transmitter.

Voice sound is received by a receiver in a wired or wireless mode and then sent to speaker E by way of the other pair of outer lead wire K and lead wire E2. Consequently, speaker E is driven to reproduce the received voice sound. The reproduced voice sound is conducted through sound tube G and metal pipe H into the external auditory canal.

It is noted that the frequency characteristics of the wearer's voice sound to be picked up within the external auditory canal in the form of bone-conducted vibration does not include much energy in the higher end of the speech frequency range, since it has incurred a substantial loss during bone-conduction, which is linearly expressed on the logarithmic scale toward a higher frequency end. Therefore, it is ordinarily necessary to correct the characteristics in the required voice sound frequency range in order to make the reproduced sound equalized to the voice sound emanating from the mouth. Heretofore, such correction is made electronically by passing voice sound electrical signals through an equalizer circuit.

The present invention makes such correction mechanically in ear microphone A. Vibrating electrode 6 of the ear microphone A, according to the present invention, is formed with perforations 6*a* or slits 6*b* as shown in FIGS. 6A to 6F in order to obtain a higher response characteristic from electrode 6, particularly in a higher frequency range. As a result, the frequency characteristics of sensitivity of ear microphone A are as shown by line "c" in FIG. 2. The frequency characteristics of voice sound signals picked by such adjusted ear microphone A shows a flat frequency characteristic, which assures an equalized output of voice sound signals, thus eliminating the need for an electrical equalizer circuit.

Figure 6A:
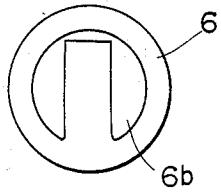
FIGS. 6A to 6F are plan views of various modifications of the vibrating electrode of the ear microphone of the invention.
Figure 6B:
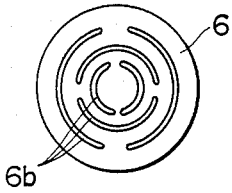
Figure 6C:
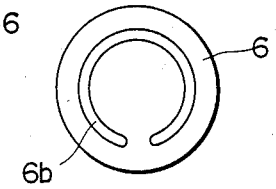
Figure 6D:
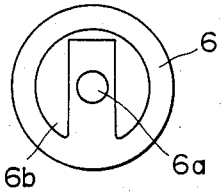
Figure 6E:
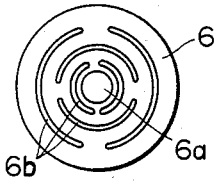
Figure 6F:
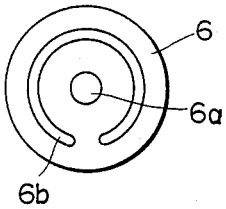

The shapes of perforations or slits 6*b* may be of any appropriate form and the illustrations of FIGS. 6A and 6F are only representative examples and are not restrictive. It is, of course, preferred that the perforations or slits be symmetrical for maintaining equilibrium in the vibrating electrode.

Figure 7A:
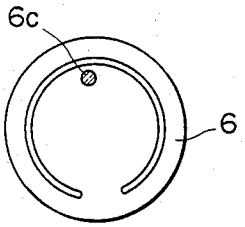
FIGS. 7A to 7D are plan views of vibrating electrodes to which a resilient member or resisting body is attached.

Referring to FIG. 7A, resilient member 6*c*, such as a rubber piece, is attached to vibrating electrode 6 so that this electrode does not collide with electret 10 at the time of occurrence of an excessive acceleration vibration. Since there is applied a relatively high voltage, such as 300 volts, across fixed electrode 9 and vibrating electrode 6, both electrodes can electrically attract each other to collide. The provision of the resilient member 6*c* is for preventing this collision even if such excessive acceleration vibration occurs.

Figure 2:
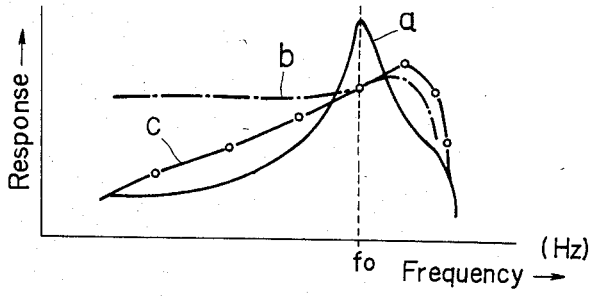
FIG. 2 is a graph showing frequency characteristics of the ear phone of the structure of FIG. 1 and those of the present invention.
Figure 7B:
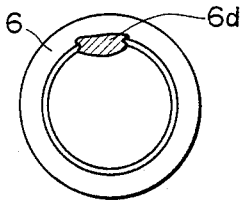

Referring to FIG. 7B, resistance body 6*d* of material such as butyl rubber is affixed to vibrating electrode 6 in order to reduce a high Q resonance at its inherent resonance frequency. Provision of this resistance body 6*d* lowers the Q resonance with the result that a smoother frequency characteristic as shown by line "c" in FIG. 2 is realized.

Figure 7C:
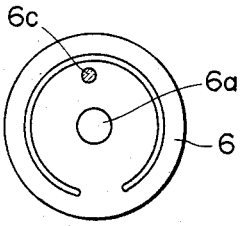
Figure 7D:
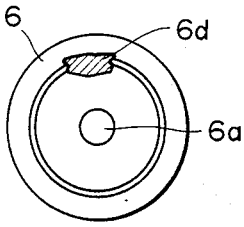

In the modifications shown in FIGS. 7C and 7D, weight 6*a* is a separate member from resilient member 6*c* or resistance body 6*d*. However, resilient member 6*c* or resisting body 6*d* may include the role of weight 6*a*.

Although explanation has been given only with respect to an ear microphone using an electret, the invention is applicable to an ear microphone without an electret, utlizing only the varying capacity between vibrating electrode 6 and fixed electrode 9.

The present invention realizes an ear microphone very suitable to an external auditory canal insertion type two-way voice communication earpiece. In other words, the ear microphone of the invention is small in size, providing more space for structure to lessen acoustic coupling (feedback) between the microphone and speaker. It is also adequately sensitive and generates less noise, both of which contribute to less complicated requirement for signal processing in subsequent operations.

The structure of the ear microphone is simple and suited for quantity production. If desirable, a mechanical equalization is achieved by slits or perforations cut in the vibrating electrode, eliminating the need for such equalization in an electrical circuit. As a result, the ear microphone makes it feasible to design a product which can function well as a voice communication terminal for a two-way voice communication system, utilizing one or two carrier frequencies, which can be worn in an ear and operated without the use of the hands.

In addition, this acceleration vibration detector will find extensive application in industrial uses, due to its very small size and its low impedance output.

What is claimed is:

1. An electrostatic type acceleration vibration detector mounted within a bone conduction ear microphone adapted to be inserted in the external auditory canal of an ear comprising:

a metal casing having a closed end and an open end, said metal casing vibrating in response to physical vibrations conducted from the surface of the external auditory canal via said ear microphone;

a grounded vibrating electrode in physical contact with said metal casing and near said closed end for vibrating in response to the vibrations of said metal casing;

a transistor positioned between said fixed electrode and said open end;

means for supporting said fixed electrode and said transistor in said metal casing; and a printed circuit board transverse said metal casing between said transistor and said open end, said circuit board having conductive patterns on its outer surface, the source and drain terminals of said transistor being connected to individual ones of said conductive patterns, the edge portions of said open end of said metal casing being bent inwardly to contact said outer surface of said circuit board and thereby to apply pressure against said supporting means for mechanically clamping the gate electrode of said transistor in electrical connection with said fixed electrode, the conductive pattern connected with said source electrode being under pressure electrical contact with said edge portions.

2. An electrostatic type acceleration vibration detector mounted within a bone conduction ear microphone adapted to be inserted in the external auditory canal of an ear comprising:

a metal casing having a closed end an an open end, said casing vibrating in response to physical vibrations conducted from the surface of the external auditory canal via said ear microphone;

a grounded vibrating electrode mounted in said casing and near said closed end for vibrating in response to the vibrations of said metal casing;

a fixed electrode located between said vibrating electrode and said open end, said fixed electrode being positioned in capacitive relation with said vibrating electrode and insulated from said metal casing;

an electret secured to said fixed electrode on a surface thereof facing said vibrating electrode;

a transistor positioned between said fixed electrode and said open end;

means for supporting said fixed electrode and said transistor in said metal casing; and a printed circuit board transverse said metal casing between said transistor and said open end, said circuit board having conductive patterns on its outer surface, the source and drain terminals of said transistor being connected to individual ones of said conductive patterns, the edge portions of said open end of said metal casing being bent inwardly to contact said outer surface of said circuit board and thereby to apply pressure against said supporting means for mechanically clamping the gate electrode of said transistor in electrical connection with said fixed electrode, the conductive pattern connected with said source electrode being under pressure electrical contact with said edge portions.

3. The electrostatic type acceleration vibration detector of claim 2 also including a resilient insulative member attached to said vibrating electrode for preventing contact between said vibrating electrode and said fixed electrode.

4. An electrostatic type acceleration vibration detector mounted within a bone conduction ear microphone adapted to be inserted in the external auditory canal of an ear comprising:

a metal casing having a closed end and an open end, said casing vibrating in response to physical vibrations conducted from the surface of the external auditory canal via said ear microphone;

a grounded vibrating electrode mounted in said casing and near said closed end for vibrating in response to the vibrations of said metal casing, said vibrating electrode including a membrane diaphragm having its periphery fixed to, and in physical and electrical contact with, said metal casing, said diaphragm being weighted to provide sufficient mass for detecting said transmitted vibrations;

a fixed electrode located between said diaphragm and said open end, said fixed electrode being positioned in capacitive relation with said diaphragm and insulated from said metal casing;

a transistor positioned between said fixed electrode and said open end;

means for supporting said fixed electrode and said transistor in said metal casing; and a printed circuit board transverse said metal casing between said transistor and said open end, said circuit board having conductive patterns on its outer surface, the source and drain terminals of said transistor being connected to individual ones of said conductive patterns, the edge portions of said open end of said metal casing being bent inwardly to contact said outer surface of said circuit board and thereby to apply pressure against said supporting means for mechanically clamping the gate electrode of said transistor in electrical connection with said fixed electrode, the conductive pattern connected with said source terminal being under pressure electrical contact with said edge portions.

5. An electrostatic type acceleration vibration detector as in claim 4 wherein said diaphragm is weighted by a metal coating on at least a portion of one side of the membrane.

6. An electrostatic type acceleration vibration detector as in claim 4 wherein said diaphragm is weighted by at least one piece of solid material attached to the diaphragm.

7. An electrostatic type acceleration vibration detector as in claim 4 wherein said diaphragm is weighted by a metal coating on at least one side thereof and by at least one piece of solid material attached to a side of the diaphragm.

8. An electrostatic type acceleration vibration detector as in claim 4 wherein said diaphragm is perforated.

9. An electrostatic type acceleration vibration detector as in claim 5 wherein said diaphragm is perforated.

10. An electrostatic type acceleration vibration detector as in claim 6 wherein said diaphragm is perforated.

11. An electrostatic type acceleration vibration detector as in claim 7 wherein said diaphragm is perforated.

12. An electrostatic type acceleration vibration detector as in claim 4 also including a resistance body attached to said membrane for reducing the Q resonance at the inherent resonance frequency of the diaphragm.

13. An electrostatic type acceleration vibration detector as in claim 5 also including a resistance body attached to said membrane for reducing the Q resonance at the inherent resonance frequency of the diaphragm.

14. An electrostatic type acceleration vibration detector as in claim 12 wherein the resistance body is composed of butyl rubber.

15. An electrostatic type acceleration vibration detector as in claim 13 wherein the resistance body is composed of butyl rubber.

16. An electrostatic type acceleration vibration detector as in claim 12 wherein said diaphragm is perforated.

17. An electrostatic type acceleration vibration detector as in claim 13 wherein said diaphragm is perforated.

18. An electrostatic type acceleration vibration detector as in claim 14 wherein said diaphragm is perforated.

19. An electrostatic type acceleration vibration detector as in claim 15 wherein said diaphragm is perforated.

* * * * *